United States Patent [19]

Kimura et al.

[11] Patent Number: 4,741,193

[45] Date of Patent: May 3, 1988

[54] METHOD AND APPARATUS FOR COOLING ROLLING MILL ROLLS

[75] Inventors: Tomoaki Kimura; Yoshio Takakura; Sakae Nishimura, all of Hitachi; Nobuyoshi Sasaki, Chiba; Toshio Ohki, Chiba; Yoshito Kawai, Chiba, all of Japan

[73] Assignees: Hitachi, Ltd., Tokyo; Kawasaki Steel Corporation, Kobe, both of Japan

[21] Appl. No.: 863,992

[22] Filed: May 16, 1986

[30] Foreign Application Priority Data

| | | | |
|---|---|---|---|
| May 17, 1985 | [JP] | Japan | 60-105642 |
| May 20, 1985 | [JP] | Japan | 60-107151 |
| May 22, 1985 | [JP] | Japan | *60-108200 |
| Sep. 19, 1985 | [JP] | Japan | 60-207120 |

[51] Int. Cl.[4] ..... B21B 27/06

[52] U.S. Cl. ..... 72/201; 72/236

[58] Field of Search ..... 72/128, 200, 201, 202, 72/236, 364

[56] References Cited

U.S. PATENT DOCUMENTS

| | | | |
|---|---|---|---|
| 3,357,224 | 12/1967 | Muller | 72/201 |
| 4,272,976 | 6/1981 | Pizzedaz | 72/201 X |
| 4,403,492 | 9/1983 | Hope | 72/201 |

FOREIGN PATENT DOCUMENTS

| | | | |
|---|---|---|---|
| 412871 | 9/1969 | Australia . | |
| 45583/68 | 5/1970 | Australia . | |
| 0130721 | 1/1985 | European Pat. Off. | 72/201 |
| 1924319 | 11/1970 | Fed. Rep. of Germany | 72/201 |
| 55-24774 | 2/1980 | Japan | 72/201 |
| 1069892 | 1/1984 | U.S.S.R. | 72/201 |

*Primary Examiner*—E. Michael Combs

*Attorney, Agent, or Firm*—Fay, Sharpe, Beall, Fagan, Minnich & McKee

[57] ABSTRACT

A roll cooling device for a rolling mill having rolls comprises cooling water guide plates each having a curved surface along a circumferential direction of rolls, the cooling water guide plates being provided close to the rolls, cooling water supply headers for supplying cooling water to cooling water passages defined by the cooling water guide plate and the rolls, water discharge headers for discharging the cooling water, supplied by the water supply headers, from the cooling water passages, support members supporting the cooling water guide plates, and curvature adjusting members for changing curvature of the guide plates in accordance with a diameter of the rolls. A thickness of the guide plate is increased from each edge portion to a central portion of the guide plate in the circumferential direction of the roll. In the case where the roll diameter is largely changed, the clearance between the guide plate and the roll is kept suitably, thereby sufficiently cool the rolls.

5 Claims, 7 Drawing Sheets

METHOD AND APPARATUS FOR COOLING ROLLING MILL ROLLS

BACKGROUND OF THE INVENTION

The present invention relates to a roll cooling device and method for cooling work rolls of a rolling mill, and more particularly to a roll cooling device and method for cooling work rolls of a strip rolling mill for rolling a sheet material or strip steel.

During a rolling operation, rolls of a rolling mill are continuously heated by a work heat due to the plastic deformation of the rolled material, a frictional heat generated between the rolled material and the rolls and the like. In particular, in case of hot rolling, since the rolled material is kept at a high temperature of about 1200° C., the resultant temperature of the rolled material becomes much higher. Also, the rolls are further heated by heat generation due to slippage between the rolls and the rolled material.

The heating of the roll first starts from the roll surface which is brought into contact with the material and subsequently, the heat is conducted from the surface radially inwardly toward the center of the roll. Also, with respect to a longitudinal direction of the roll, the heat is conducted from the longitudinal central portion of the roll toward both ends of the roll. As a result, with respect to the longitudinal direction of the roll, the temperature of the central portion is kept highest and the temperature is gradually decreased toward the ends of the roll. Consequently, due to the heat expansion, the diameter of the roll becomes larger in the central portion than at both ends. In case of hot rolling, this difference in diameter due to heat expansion reaches about 0.1 to 0.4 mm.

When the roll has a larger diameter in its central portion and a smaller diameter at both end portions, a thickness of the central portion of the rolled material is smaller than that of the edge portions of the rolled material, thus causing a problem that the rolling precision deteriorates. Also, when the temperature of the roll is elevated, the roll is thermally stuck to the material, resulting in degradation in quality of the product.

Accordingly, the rolls of the rolling mill must be always cooled during the rolling operation. For this reason, the cooling of the rolls has been performed by injecting cooling water onto the roll surface apart from the position of the rolls by means of spray nozzles. An average heat transfer coefficient from the roll surface is limited to 3,000 kcal/m$^2$hr °C. and hence, the cooling performance is limited. To obviate such defects, various attempts have been made to increase a flow rate of the cooling water or to increase a pressure of the cooling water. However, this is also limited and is not sufficient to cool the roll.

To solve such problems of insufficient cooling, Japanese Patent Examined Publication No. 12322/1980 proposes an improved method. According to this prior art method, a cooling water guide having a shape in conformity with an outer periphery of a roll is arranged in constant spaced relation with the roll, and the cooling water is forcibly supplied into a clearance between the cooling water guide and the roll so that an average heat transfer coefficient is increased to about four times of the conventional one. However, such a prior art method suffers from the following disadvantages.

(1) The roll is worn by rolling the material and is periodically abraded by 0.1 to 0.5 mm in terms of the diameter. In the cooling apparatus as disclosed in the above-mentioned Japanese publication No. 12322/1980, the cooling water guide is made of flexible material and is deformed by a fluid resistance of the cooling water supplied between the cooling water guide and the roll so that the cooling water guide may follow the change in diameter of the roll. However, according to such a method that the cooling water guide is deformed by utilizing the fluid pressure, it is impossible to obtain an increased fluid pressure and it is difficult to increase the deformity. The resultant deformity is only enough to follow the roll diameter change of about several millimeters. On the other hand, the extent of roll abrasion from new use finally reaches about 10% of the roll diameter. The deformity of the cooling water guide plate cannot meet such a roll diameter change and it is impossible to sufficiently cool the roll. Also, if the flow rate of the cooling water would be decreased for some reason, there is a fear that the fluid pressure would be reduced so that the cooling water guide plate and the roll would be in contact with each other. This causes a problem of the cooling water guide plate being undesirably stuck to the roll.

(2) Since the cooling water guide is located extremely near to the roll, it is necessary, upon replacement of the rolls, to move the cooling water guide away from the roll. This makes the structure complicated and increases the time needed for the roll replacement.

In view of an economical point, it is preferable that the clearance or gap between the cooling water guide plate and the roll be reduced as much as possible, to reduce the amount of the cooling water passing through the clearance (cooling water passage). In order to maintain this extremely small clearance accurately, pipings and tubes must be flexible because there is a necessity to move the cooling water guide as described above. However, generally used rubber hoses impose a local load to the cooling water guide due to their rigidity and hence, it is difficult to keep the clearance constant.

Also, Japanese Patent Unexamined Publication No. 83658/1979 shows a roll cooling device in which cooling headers are internally formed and roll cooling pads provided with a plurality of cooling water injection ports communicating with the cooling headers are supported by bearing boxes. However, in the conventional roll cooling device, since the cooling water supply to the cooling pads is carried out by using water supply holes passing through the bearing boxes, a mechanical strength of the bearing boxes is reduced, and in view of the roll replacement, it is necessary to provide a means for attaching/detaching external water supply tubes connected to the water supply holes formed in the bearing boxes. This makes the structure complicated and increases the time needed for the roll replacement.

SUMMARY OF THE INVENTION

A primary object of the invention is to provide a roll cooling device for a rolling mill, which is capable of sufficiently cooling rolls while keeping suitably a clearance between the cooling water guide plate and the roll, even if the diameter of the rolls is largely changed.

Another object of the invention is to provide a roll cooling device for a rolling mill, which is capable of readily performing the attachment/detachment of cooling water charge/discharge tubes with respect to a cooling pad upon the roll displacement.

Still another object of the invention is to provide a roll cooling device for a rolling mill, which is capable of cooling the rolls with a high efficiency, upon supplying cooling water to cooling water jackets provided along the rolls.

According to a first aspect of the invention, there is provided a roll cooling device for a rolling mill, wherein curvature adjusting members for changing a curvature of a cooling water guide plate provided along an outer periphery of each roll are mounted on a support member of the cooling water guide plate to change the curvature of the cooling water guide plate in accordance with a change in diameter of the roll and to maintain suitably a clearance between the cooling water guide plate and the roll.

According to a second aspect of the invention, there is provided a roll cooling device for a rolling mill, wherein each cooling water guide plate provided along an associated work roll has a thickness that is increased from its edge portions toward its central portion in a curcumferential direction of the roll whereby, when the curvature of the cooling water guide plate is changed, the clearance between the cooling water guide plate and the roll may be kept suitably constant.

According to a third aspect of the invention, there is provided a roll cooling device for a rolling mill, wherein water charge/discharge tubes are connected to joint members detachably coupled to the cooling pad, and the joint members are moved toward or away from the roll by moving means to carry out the attachment-/detachment of the cooling pads and the joint members so that the attachment/detachment of the cooling pad water charge/discharge tubes may readily be carried out upon the roll replacement.

According to a fourth aspect of the invention, there is provided a roll cooling method for cooling rolls of a rolling mill with a high efficiency during a rolling operation, including the steps of providing cooling water jackets along outer peripheries of the rolls so that cooling water contacts with the outer peripheries of the rolls and supplying the cooling water into the cooling water jackets. The method is characterized in that a clearance between each of the cooling water jackets and an associated one of the outer peripheries of the rolls is in a range of 2 to 5 mm and a cooling water speed within the cooling water jackets is in a range of 5 to 30 m/sec.

DESCRIPTION OF THE PREFERRED EMBODIMENTS

A preferred embodiment of a roll cooling device for a rolling mill according to the present invention will now be described with reference to the accompanying drawings.

Figure 1:
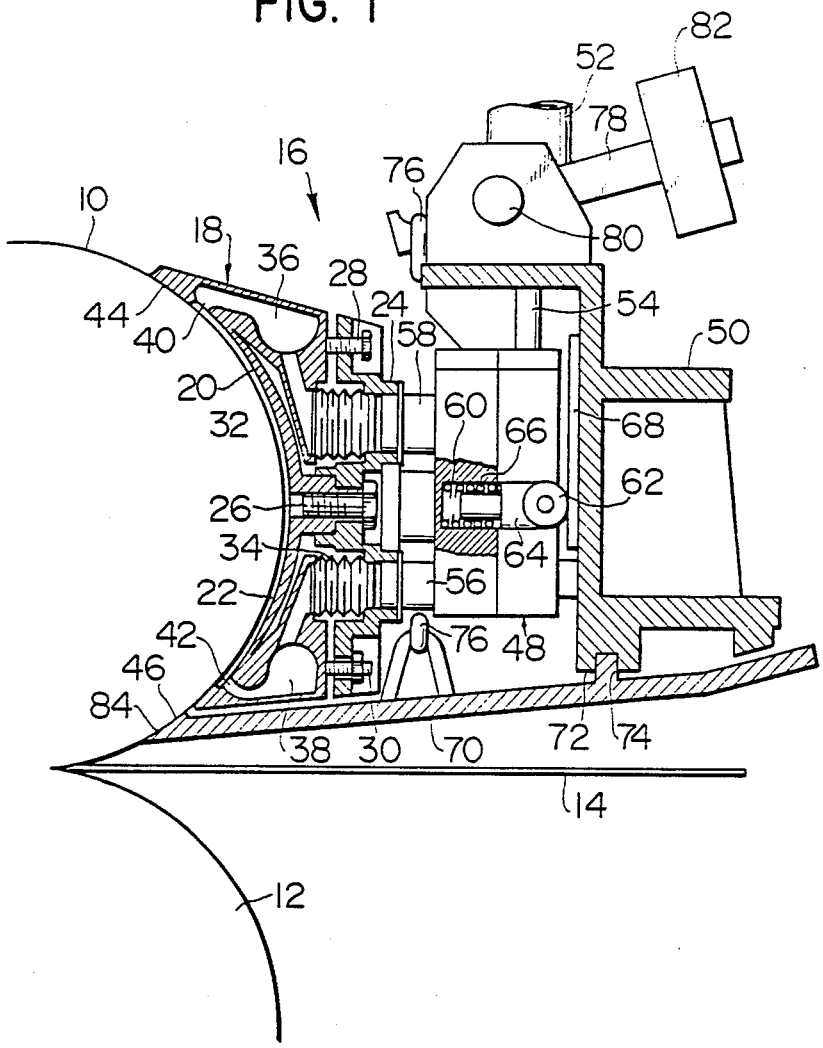
FIG. 1 is a cross-sectional view showing one embodiment of a roll cooling device for a rolling mill in accordance with the present invention.

FIG. 1 shows a cross-sectional view of the roll cooling device embodying the present invention.

In FIG. 1, reference numerals 10 and 12 denote an upper work roll and a lower work roll, respectively, for rolling a material 14 to be rolled. The cooling device generally designated by reference numeral 16 is provided in contact with the upper work roll 10. Also, another cooling device is provided for the lower work roll 12 as described later. A cooling pad 18 of the cooling device 16 has a cooling water guide plate 20 at its surface confronting upper work roll 10. The guide plate 20 is thin at its edge portions and thick in its central portion. The guide plate 20 is formed integrally with the cooling pad 18. The guide plate 20 extends along an axis of the upper roll 10 and is curved along a circumferential periphery of the upper work roll 10 so that a cooling water passage 22 is formed between the guide plate 20 and the upper work roll 10. The cooling pad 18 is provided with a plurality of threaded bores along the axial direction of the upper work roll 10 in a central portion of the cooling water guide plate 20. A plurality of bolts 26 passing through a reference beam 24 are threadedly engaged with the threaded bores, so that the cooling pad 18 is supported by the reference beam 24. Distal end portions of screws 28 and 30 which are in threaded engagement with the reference beam 24 engage upper and lower edge portions, on a back side, of the cooling pad 18, so that the cooling pad 18 may be pushed or drawn. Furthermore, the cooling pad 18 and the reference beam 24 are coupled to each other by extendable and contractable tubular joints 32 and 34 such as bellows. The tubular joints 32 and 34 communicate with a water discharge header 36 and a water supply header 38 through fluid passages formed in the cooling pad 18. The water discharge header 36 communicates with the cooling water passage 22 through water discharge ports 40 formed at the upper edge portion of the cooling water guide plate 20, whereas the water supply header 38 communicates with the cooling water passage 22 through slit nozzles 42 formed at the lower edge portion of the cooling water guide plate 20. The cooling pad 18 is provided with seal portions 44 and 46 which are held in contact with the upper work roll 10 at the upper and lower edge portions of the cooling water guide plate 20, respectively.

Disposed behind the reference beam 24 is a water charge/discharge block 48 to be described in detail later. The water charge/discharge block 48 is suspended from a piston rod 54 of a pneumatic cylinder 52 fixed to an upper portion of a bracket 50. A water supply tube end 56 and a water discharge tube end 58 are inserted into the reference beam 24. A pin 64 which carries thereon a roller 62 rotatably is inserted into a pin hole 60 formed in the charge/discharge block 48. The pin 64 is biased in the right direction in FIG. 1 by a spring 66 so that the roller 62 is brought into contact with a base plate 68 provided on a side wall of the bracket 50.

An upper guide plate 70 is provided below the cooling pad 18 and the water charge/discharge block 48, with its fulcrum portion 72 being inserted into an insertion hole formed in the bracket 50. A chain 76 is mounted on an upper surface of the upper guide plate 70 and is in turn engaged with a hook portion of the swing arm 78 provided at the upper portion of the bracket 50. The swing arm 78 is swingably mounted on the bracket 50 through a pin 80 and has a counterweight 82 opposite to the hook portion thereof. Thus, the swing arm 78 is subjected to a rotational force (clockwise in FIG. 1) about the pin 80 by the counterweight 82; that is, the upper guide plate 70 is urged to rotate in the clockwise direction about the fulcrum portion 72 so that a tip edge portion 84 of the upper guide plate 70 is brought into contact with the upper work roll 10.

Figure 2:
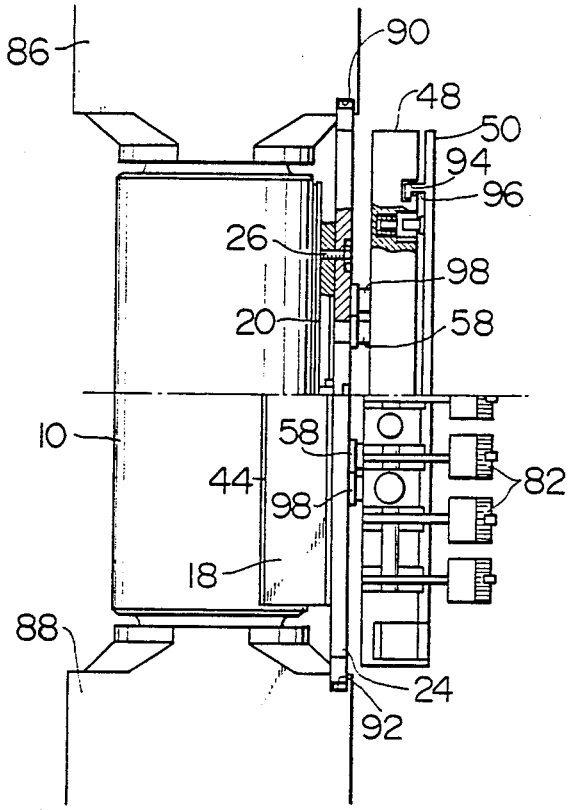
FIG. 2 is a partial cross-sectional and partial plan view of the roll cooling device shown in FIG. 1, as viewed in the roll axial direction.

As best shown in FIG. 2, the opposite axial ends of the upper work roll 10 are mounted on bearing boxes 86 and 88 while the reference beam 24 is inserted into guide grooves 90 and 92 formed in the bearing boxes 86 and 88 bearing rotatably the upper work roll 10. On the other hand, in the water charge/discharge block 48, there is formed an engagement groove 94 engaged by an engagement portion 96 of the bracket 50, so that the water charge/discharge block 48 and the bracket 50 may be moved together. On a front face of the water charge/discharge block 48, there is formed a cylindrical coupling protrusion 98 which is inserted into an associated bore formed in the reference beam 24.

Figure 3:
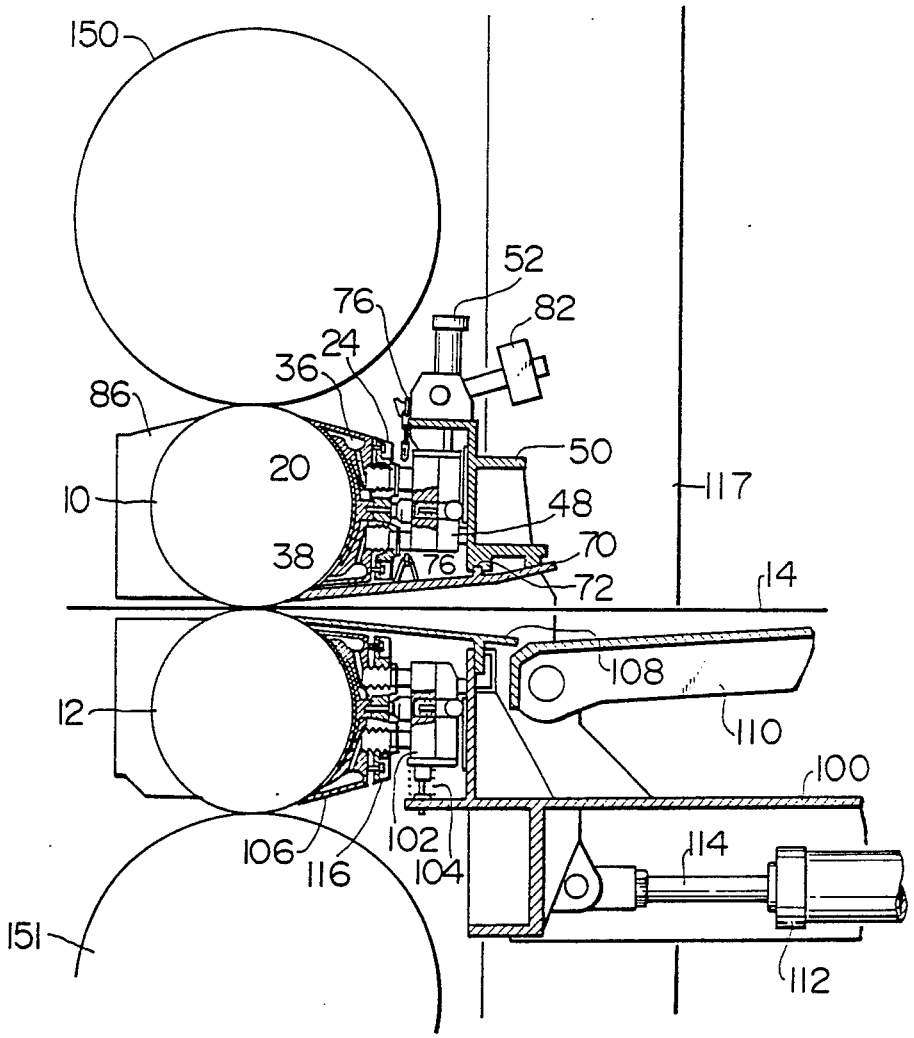
FIG. 3 is a cross-sectional view showing a primary part of multi-roll mill provided with the roll cooling device shown in FIG. 1.

As shown in FIG. 3, the bracket 50 supporting the water charge/discharge block 48 is fixed to a bracket 100. The bracket 100 supports through a spring 104 a water charge/discharge block 102 which is similar to the water charge/discharge block 48. Located above the water charge/discharge block 102 and a cooling pad 106 provided in contact with the lower work roll is a lower guide plate 108 fixed to the bracket 100. Further, disposed on a rear side of the lower guide plate 108 is a guide plate 110 fixed to the bracket 100. The bracket 100 is coupled to a piston rod 114 of a cylinder 112, so that as the cylinder 112 operates, the bracket 100 is moved rearwardly or forwardly with respect to the upper and lower work rolls 10 and 12, thereby separating the water charge/discharge blocks 48 and 102 apart from the reference beams 24 and 116.

Figure 4:
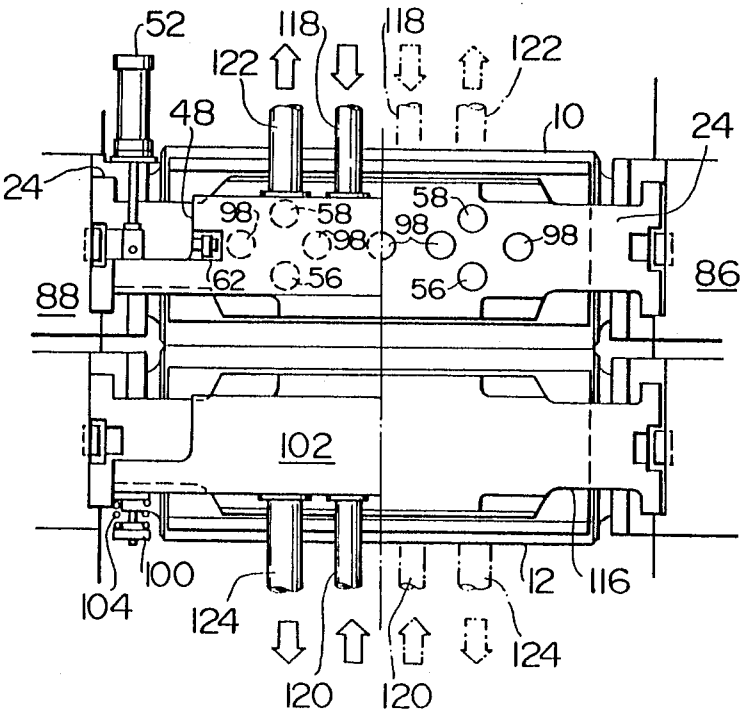
FIG. 4 is a front elevational view showing one example of a water charge/discharge block for charging/discharging cooling water to the roll cooling device shown in FIG. 1.

As shown in FIG. 4, the water charge/discharge blocks 48 and 102 are connected to two water supply tubes 118 and 120 and two water discharge tube 122 and 124, respectively. It is to be noted that the reference beams 24 and 116 are arranged with their first end (in the right of FIG. 4) being spaced slightly apart from the bearing boxes, thus preventing an interference with the bearing boxes due to heat expansion. In FIG. 3, reference numeral 117 denotes a mill housing for carrying the works 10 and 12 or the like of the rolling mill. Reference numerals 150 and 151 denotes support or backup rolls for supporting the upper and lower rolls 10 and 12, respectively.

The operation of the apparatus will be described hereinafter.

The cooling water for cooling the upper work roll 10 is led through the water supply tube 118 to the water charge/discharge block 48 and is introduced from the water supply tube end 56 of the water charge/discharge block 48 through the tubular joint 34 to the water supply header 38. Thereafter, the cooling water is injected from the slit nozzles 42 to the peripheral surface of the upper work roll 10 to cool the upper work roll 10 while the water is rising through the cooling water passage 22. The water is introduced from the water discharge port 40 to the water discharge header 36. Further, the cooling water enters the tubular joint 32 of the water discharge header 36 and is led through the water discharge tube end 58 to the water charge/discharge block 48 and discharged through the water discharge tube 122 to the outside. The above-described operation is similarly applicable to the cooling of the lower work roll 12.

The roll replacement for abrading the work rolls due to the wear of the work rolls will be conducted as follows. First of all, the cylinder 112 shown in FIG. 3 is operated to retract the piston rod 114 toward the cylinder 112. Then, the bracket 100 fixed to the piston rod 114 is moved in the right in FIG. 3. As a result, the upper guide plate 70 and the water charge/discharge block 48 supported by the bracket 50 integral with the bracket 100 for cooling the upper work roll are moved in the right direction in FIG. 3. Also, the lower guide plate 108, the guide plate 110 and the water charge/discharge block 102 mounted on the bracket 100 for cooling the lower work roll 12, move together with the bracket 100. Consequently, the couplings between the water charge/discharge blocks 48, 102 and the reference beams 24, 116 are released. The water charge/discharge blocks 48 and 102 are exposed outside of the mill housing 117 provided that the blocks are connected to the water supply tubes 118, 120 and the water discharge tubes 122, 124. By an exchange cart to be guided by guide rails (not shown) for exchanging rolls, the upper and lower work rolls 10 and 12 are moved outside of the mill housing under such a condition that the cooling pads 18, 106 and the reference beams 24, 116 are mounted on the bearing boxes. When, for example, the upper work roll 10 is replaced by a new work roll, by adjusting the screws 28 and 30, a curvature of the cooling water guide plate 20 is adjusted thus obtaining a suitable cooling water passage 22. After the upper and lower work rolls 10 and 12 have been incorporated into the mill housing 117, the bracket 100 is advanced by the cylinder 112 so that the water charge/discharge blocks 48, 102 are coupled to the reference beams 24, 116 and the upper guide plate 70, the lower guide plate 108 and the guide plate 110 are located at predetermined positions.

As described above, in the preferred embodiment, it is possible to adjust the position of the cooling water guide plate 20 relative to the work rolls by adjusting the bolts 26. In addition, the cooling water block 18 is moved toward or away from the roll by the adjustment of the screws 28 and 30 to thereby change the curvature of the cooling water guide plate 20 in conformity with a diameter of the roll so as to maintain a suitable cooling water passage 22 for sufficiently cooling the work roll. Moreover, since the deformation of the cooling water guide plate 20 is based upon the reference position of the reference beam mounted on the bearing boxes of the work roll, it is possible to accurately set the cooling water guide plate with respect to the work roll. Also, because the reference beam and the cooling pad are coupled to each other by the extendable and contractable tubular joints, the structure may correspond to the deformation of the cooling water guide plate 20 (and hence the deformation of the cooling pad 18), thereby supplying the water smoothly. Furthermore, in the preferred embodiment, since the water charge/discharge blocks 48 and 102, to which the water supply tubes 118, 120 and the water discharge tubes 122, 124 are connected, are moved toward or away from the rolls together with the upper guide plate 70, the lower guide plate 108 and the guide plate 110, thereby carrying out the coupling/release between the cooling pads 18, 106 and the water charge/discharge blocks 48, 102, the roll replacement may readily be attained. The roll cooling device in accordance with the preferred embodiment is suitably applicable to a hot tandem strip mill. In the hot tandem strip mill, a strip which is 1.2 to 12 mm thick and 900 to 1600 mm wide is rolled at a maximum speed of about 1200 m/min. The hot tandem strip mill is composed of 6 or 7 roll machines with rolls each having a diameter of 600 to 700 mm and a length of 1800 mm.

Also, in the case where the cooling device is applied to a thick strip mill having a large diameter of say 1200 mm, it is possible to increase the number of the screws for moving the cooling pad 18 toward or apart from the roll. For example, the screws are provided between the bolt 26 and the screw 28 and between the bolt 26 and the screw 30, thereby enhancing the effect. Although, in the preferred embodiment, the bolt 26 simply serves to support the cooling pad 18, the bolt 26 may be structured like the screws 28 and 30, thereby making use of the bolt 26 for adjustment of the cooling water passage 22.

As has been described above, in accordance with the present invention, even if the roll diameter is largely changed due to, for example, abrasion of the roll, the gap or clearance between the roll and the cooling water guide plate may be suitably adjusted with such an effect that the roll may be sufficiently cooled.

Moreover, in the preferred embodiment, since the water supply tubes and the water discharge tubes are connected to the water charge/discharge block supported by the bracket, any local load is not applied to the cooling pad. Thus, the cooling water passage 22 may be maintained suitably.

According to the present invention, there is an advantage that the water charge/discharge tubes of the cooling pad may readily be mounted or dismounted upon the roll replacement.

Also, in the above-described embodiment, the cooling water plate 20 is so constructed that a thickness thereof at opposite edges is decreased while a thickness thereof in the central portion is increased along the circumferential direction of the roll. The effect of the structure where the edge portions of the cooling water guide plate 20 are thin and the central portion is thick will now be described with reference to FIG. 5. If a y-axis is determined with respect to a reference point of the upper end 20*a* of the cooling water guide plate 20 and extends downwardly, a moment M applied to the guide plate 20 is expressed by the following formula:

$$M = y \cdot W$$

where W is the deformity force of the guide plate 20. The guide plate 20 is bent by the moment M in accordance with the following equation (1):

$$\frac{M}{EI} = \frac{yW}{EI} = \frac{1}{\rho} \tag{1}$$

where E is Young's modulus;

$$I = \frac{Bh^3}{12};$$

B is the width of the plate; h is the thickness of the plate; and $\rho$ is the radius of curvature by flexure.

In order to keep constant the value of $\rho$ in the above equation, it is necessary to keep constant the value of yW/EI. In this case, since W and E are constants, it is sufficient to keep y/I constant. From $I = Bh^3/12$, the following equation is given:

$$y/I = 12y/Bh^3$$

In this equation, since B is constant, after all, it is sufficient to keep $y/h^3$ constant.

If $y/h^3 = K$ (constant), $$h = \sqrt[3]{y/K} \tag{2}$$

from equation (2), if the plate thickness is increased in accordance with an arithmatic root of y, it is possible to keep $\rho$ constant.

Figure 5:
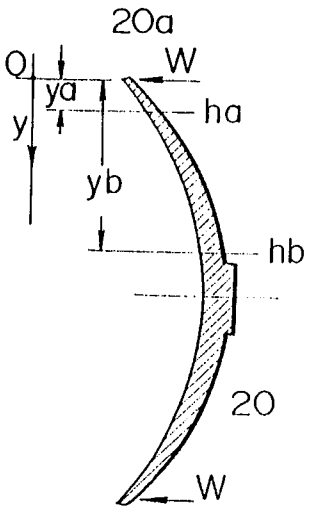
FIG. 5 is an illustration of the deformity of a water guide mounted on the roll cooling device shown in FIG. 1.

In the relation shown in FIG. 5, the following equation is given:

$$h_b = h_a \sqrt[3]{y_b/y_a}$$

where $h_a$ and $h_b$ are the thicknesses at the positions of $y = y_a$ and $y = y_b$, respectively.

For example, if $y_a = 50$ mm, $h_a = 3$ mm and $y_b = 220$ mm, the following equation is given:

$$h_b = 3\sqrt[3]{220/50} \approx 4.9 \text{ mm}$$

If the plate thickness h is increased together with y, the radius $\rho$ of the curvature by flexure is kept substantially constant and the deformation may be attained along an essentially arcuate shape.

As described above, in the preferred embodiment, when the cooling water guide plate confronting the surface of the work roll is forcibly deformed by the displacement adjusting mechanism provided on the reference beam, it is possible to keep constant the clearance between the work roll and the cooling water guide plate, thus enabling the ideal compensation or correction against the change in roll diameter.

Although, in the preferred embodiment, the four roll machine (4-high) has been explained, it is apparent that the invention is applicable to a six roll machine (6-high).

An example of an apparatus for carrying out a roll cooling method for a rolling mill will now be described with reference to FIGS. 6 and 7.

Figure 6:
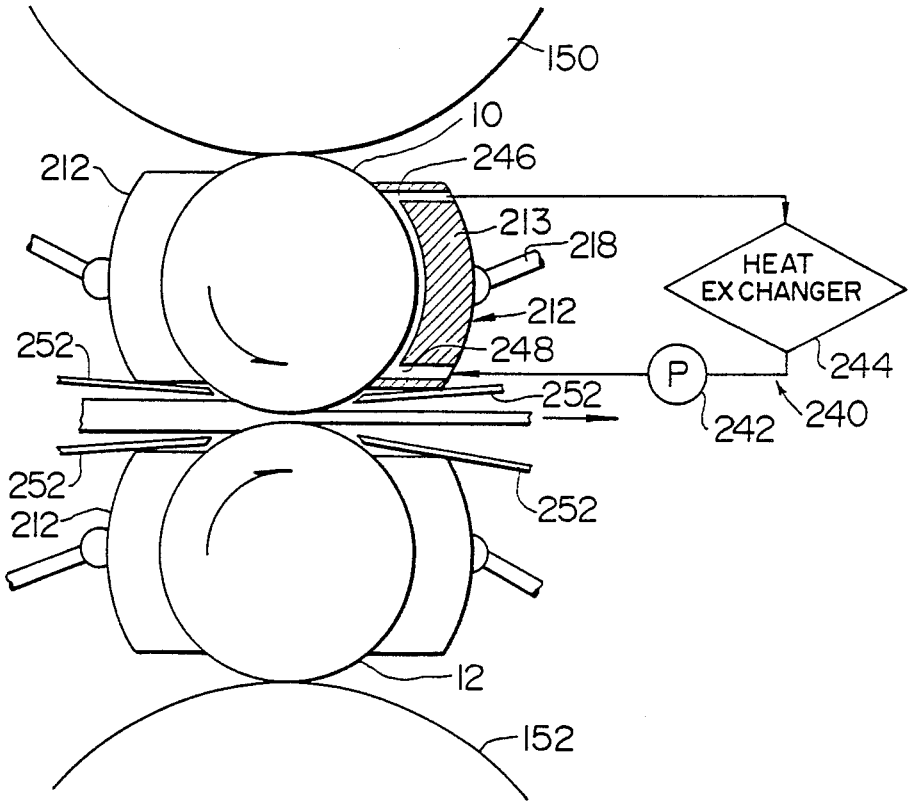
FIG. 6 is a cross-sectional view showing another embodiment of a roll cooling device for a rolling mill in accordance with the present invention.
Figure 7:
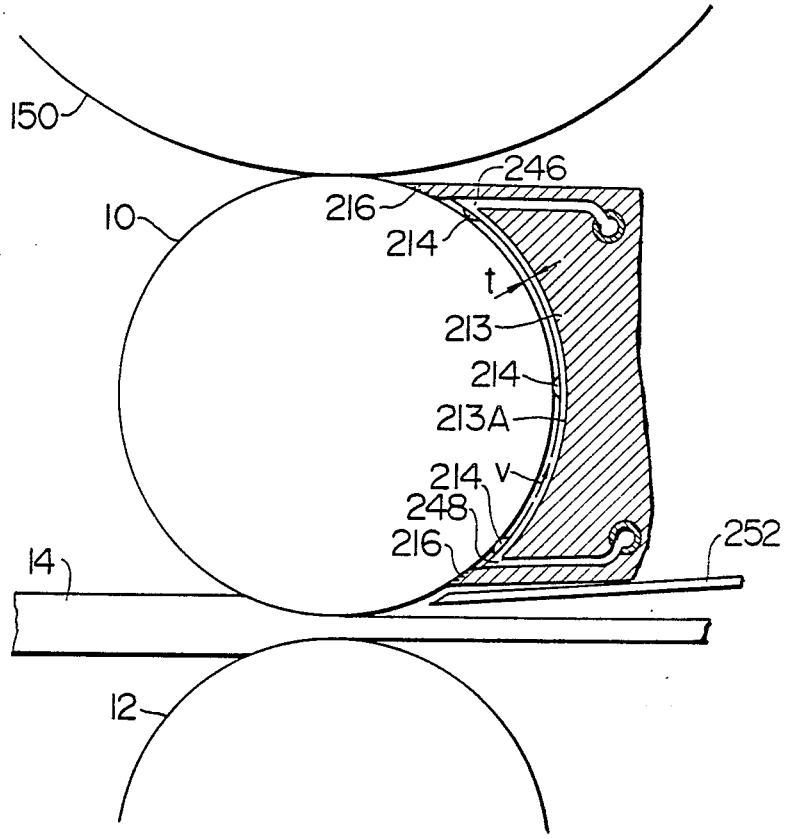
FIG. 7 is an enlarged view showing a primary part of the roll cooling device shown in FIG. 6.

In the apparatus shown in FIGS. 6 and 7, a cooling water jacket 212 is provided along an outer periphery of each of rolls 10, 12 so that the cooling water is kept in contact with the outer periphery of each roll 10, 12. In the cooling method in which the roll cooling water is supplied in the cooling water jackets 212 to cool the working rolls 10 and 12, a clearance t between a bottom surface 213 of a rectangular roll confronting portion 213, confronting each roll 10, 12, of each cooling water jacket 212 and the peripheral surface of the roll is kept in a range of 2 to 5 mm, and a cooling water speed v within the cooling water jacket 212 is kept in a range of 5 to 30 m/sec.

At each end, in the axial direction of the roll, of the roll confronting portion 213, there are provided three contact rolls 214 which may roll in contact with the outer periphery of the roll 10, 12 and which are spaced equidistantly from each other in the circumferential direction so as to be projected from the bottom surface of the roll confronting portion 213. At the same time, a labyrinth seal is formed over the entire circumferential edge of the roll confronting portion 213 of the cooling water jacket 212.

The water jacket 212, including the contact rolls 214, is biased toward the outer peripheral surface of the work roll 10 (12) by a pusher mechanism 218 (part of which is shown). In FIG. 6, reference numeral 240 denotes a recirculating cooling water system supplying the cooling water into the cooling water jacket 212. The cooling water system 240 has a pump 242 and a heat exchanger 244 and is connected to water supply port 246 and a water discharge port 248 which are formed in the cooling water jacket 212. Reference numerals 150 and 152 denote backup rolls contacting upper and lower portions of the rolls 10 and 12 and rotating for controlling the positions of the work rolls 10 and 12, respectively. Numeral 252 denotes guide means for guiding the smooth introduction and extraction of the material 14 between the work rolls 10 and 12.

In the embodiment, when the cooling water is supplied from the cooling water system 240 to the cooling water jacket 212 interior during the rotation of the work rolls 10 and 12, a seal effect is obtained between the cooling water jacket 212 and the work roll 10 (12) by the labyrinth seal 216 held close to the outer periphery of the roll 10 (12), so that a cooling water passage is formed along the outer periphery of the roll 10 (12). As a result, the work rolls 10 and 12 are cooled by the cooling water recirculating within the cooling water jacket 212 at the speed v in the range of 5 to 30 m/sec.

It should be noted that the clearance t between the outer periphery of the roll 10 (12) and the bottom surface 213A of the roll confronting portion 213 of the cooling water jacket 212 is kept constant at a value in the range of 2 to 5 mm.

The above-specified ranges of v=5 to 30 m/sec and t=2 to 5 mm were confirmed by various experiments made by the present inventors.

Figure 8:
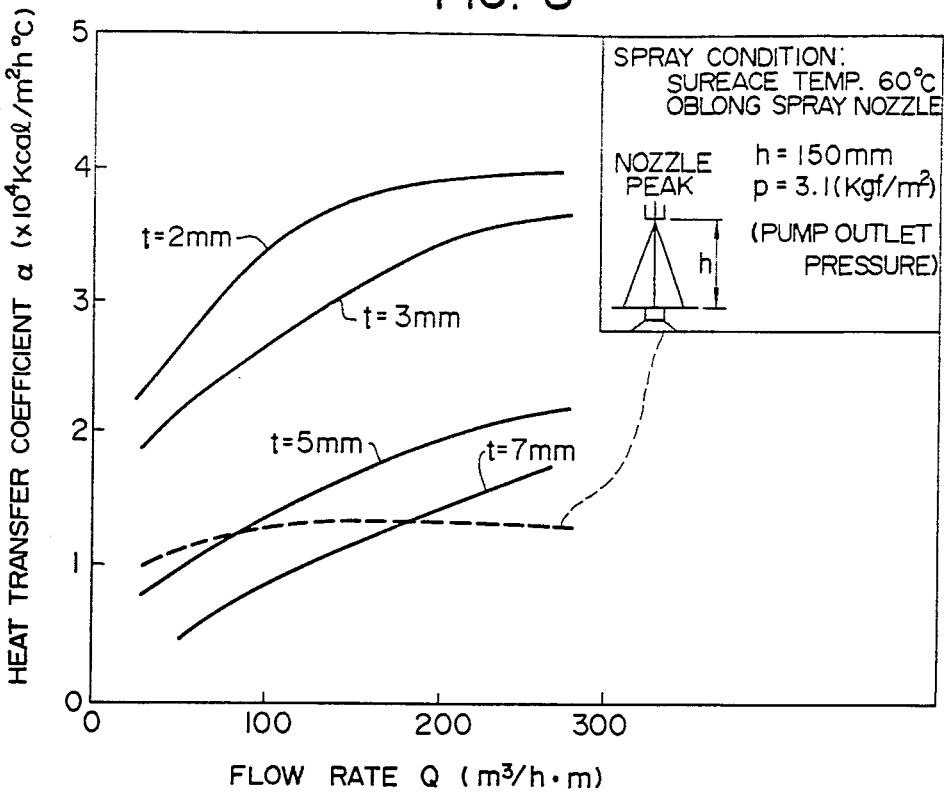
FIG. 8 is a graph showing a relationship between the flow rate of the cooling water and the cooling ability of the roll cooling device shown in FIG. 6, with respect to the clearance between the cooling water jackets and the work rolls.
Figure 9:
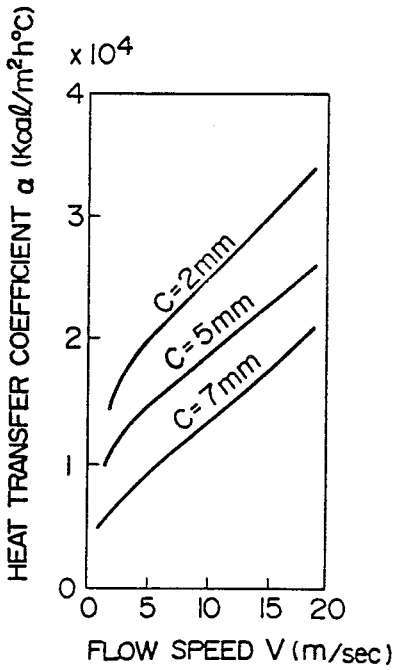
FIG. 9 is a graph showing a relationship between the cooling efficiency and the cooling water flow speed in the cooling device shown in FIG. 6, with respect to the clearance between the cooling water jackets and the work rolls.

More specifically, in the case where the peripheral surface of the roll 10 (12) was spaced from the bottom surface 213A of the roll confronting portion 213 at the clearance t of 2 mm, 3 mm, 5 mm and 6 mm, respectively, a relationship between flow rate Q of the cooling water supplied between the clearance and the outer periphery of the work roll 10 (12) and coefficient $\alpha$ of heat transfer was that, the shorter the clearance t or the larger the flow rate Q, the greater the heat transfer coefficient $\alpha$ would become, as shown in FIG. 8.

In comparison with a conventional spray method indicated by the dotted line in the graph shown in FIG. 8, it was found that, under the condition that the clearance t was not more than 5 mm with the flow rate Q of 100 $m^3/h \cdot m$ or more, the cooling ability of the jacket cooling method was superior to that of the spray. In this case, the flow rate Q of 100 $m^3/h \cdot m$ corresponds to the speed v of 5 m/sec in the case of t=5 mm. Also, in the case of t=2 mm, the cooling ability was saturated above Q=200 $m^3/h \cdot m$ as shown in FIG. 8. At this time, the speed v of the cooling water which corresponded to the flow rate Q of 200 $m^3/h \cdot m$ was at 30 m/sec.

On the other hand, if the clearance t is less than 2 mm, the cooling ability per unit water quantity of the cooling water is increased, but it is difficult to provide the mechanical components for maintaining the clearance t less than 2 mm. Also, the pressure loss is increased. As a result, the pressure of the cooling water to be supplied must be increased. Therefore, in this case, it is impossible to reduce the consumption of electric power.

For this reason, it is preferable that the clearance t be at 2 mm or more. Accordingly, it is preferable that the clearance t be in a range of 2 to 5 mm and the supply speed v of the cooling water fed to the clearance be in a range of 5 to 30 m/sec.

In the embodiment, although the three contact rolls 214 are arranged equidistantly in the circumferential direction at each axial end of the work roll in the roll confronting portion 213 of the water jacket 212, it is apparent that the invention is not limited thereto but the number of the arranged contact rolls 214 may be increased or decreased in accordance with the diameter of the work rolls 10 and 12.

Furthermore, as a mechanism for keeping in the range of 2 to 5 mm the clearance t between the bottom surface 213A of the roll confronting portion 213 in the cooling water jacket 212 and the work roll 10 (12), the application is not limited to the contact rolls 214 shown in the embodiment. If the clearance may be kept suitably, any structure may be used.

Also, as a means for forming a closed cycle by contacting the water jacket 212 against the outer periphery of the work roll 10 (12), the rectangular labyrinth seal 216 is applied to the roll confronting portion 213 in the embodiment but, if any other sealing means is available, the structure is not limited to that shown in the embodiment.

As has been described above, according to the present invention, it is possible to attain the cooling of the work rolls by using the cooling water jackets.

We claim:

1. A roll cooling device for a rolling mill having rolls, comprising at least one cooling water guide plate having a curved surface along a circumferential direction of an associated one of said rolls, said cooling water guide plate having opposite circumferential ends being positioned in close proximity to the associated roll; a cooling water passage formed between said guide plate and the associated roll; cooling water supply means for suuplying cooling water to said cooling water passage; water discharge means for discharging the cooling water from said cooling water passage; said cooling water supply means being positioned at one of said circumferential ends of said cooling water guide plate; said cooling water discharge means being positioned at the other of said circumferential ends of said cooling water guide plate such that the cooling water flows through said cooling water passage in the circumferential direction of the roll from said cooling water supply means to said cooling water discharge means; a support member for supporting said cooling water guide plate; and said cooling water guide plate having a central portion and circumferentially opposed upper and lower edge portions, wherein a thickness of the cooling water guide plate is increased from each edge portion to the central portion in the circumferential direction of the associated roll.

2. The roll device according to claim 1, further comprising: a reference beam; said cooling water guide plate being fixed to said reference beam at said central portion; and curvature adjusting means for changing a curvature of said cooling water guide plate in accordance with a diameter of the associated roll, said curvature adjusting means including means for adjusting the position of the upper and lower edge portions of said cooling water guide plate in relation to said reference beam such that the upper and lower edge portions are adjustably positionable by said curvature adjusting means in relation to the associated roll.

3. A roll cooling device for a rolling mill having rolls, comprising at least one cooling pad having a cooling water guide plate; bearing boxes for supporting an associated one of said rolls and for supporting said cooling water guide plate, said cooling water guide plate being curved along a peripheral surface of the roll, a cooling water passage formed between said cooling water guide plate and the peripheral surface of the roll; a water supply header for supplying said cooling water passage with cooling water; a water discharge header for discharging the cooling water from said cooling water passage; a water supply tube communicating with said water supply header; a water discharge tube communicating with said water discharge header; joint means for detachably coupling said cooling pad from said water supply and water discharge tubes; and moving means for moving said joint means toward or away from the roll for releasably coupling said water supply and said water discharge tubes to said water supply and said water discharge headers respectively.

4. The roll cooling device according to claim 3, further comprising: a bracket and a guide mounted on the bracket for guiding a material to be rolled by the rolls; said joint means being mounted on said bracket; and said moving means including drive means for moving said brackets back and forth with respect to the rolls.

5. A roll cooling method for cooling rolls of a rolling mill during a rolling operation, comprising the steps of:

providing cooling water jackets along outer peripheries of the rolls in a circumferential direction so that cooling water contacts said outer peripheries;

supplying the cooling water into the cooling water jackets;

providing a nozzle for supplying cooling water into the cooling water jackets at one end of the jacket, and providing a water discharge port at the other end of the water jackets for receiving the discharged water from the water jackets such that the cooling water flows through the jacket in the circumferential direction of the roll between said nozzle and said discharge port;

providing a clearance between each of said cooling water jackets and an associated one of the outer peripheries of the rolls in a range of 2 to 5 mm; and supplying the cooling water at a speed within the cooling water jackets in a range of 5 to 30 m/sec.

* * * * *